US009163344B2

(12) United States Patent
Kawaguchi et al.

(10) Patent No.: US 9,163,344 B2
(45) Date of Patent: Oct. 20, 2015

(54) SEWING MACHINE AND EMBROIDERY FRAME

(71) Applicants: Yasuhiko Kawaguchi, Nagoya (JP); Yuki Ihira, Kakamigahara (JP); Takahira Osamura, Kitanagoya (JP)

(72) Inventors: Yasuhiko Kawaguchi, Nagoya (JP); Yuki Ihira, Kakamigahara (JP); Takahira Osamura, Kitanagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 14/199,014

(22) Filed: Mar. 6, 2014

(65) Prior Publication Data

US 2014/0283721 A1 Sep. 25, 2014

(30) Foreign Application Priority Data

Mar. 21, 2013 (JP) ..... 2013-057948

(51) Int. Cl.

*D05B 19/08* (2006.01)
*D05B 21/00* (2006.01)
*D05B 19/12* (2006.01)
(Continued)

(52) U.S. Cl.

CPC ..... *D05B 19/12* (2013.01); *D05B 19/08* (2013.01); *D05B 21/00* (2013.01); *D05C 9/00* (2013.01); *D05C 9/06* (2013.01)

(58) Field of Classification Search

CPC ..... A41D 27/08; B25H 7/00; D05B 19/02; D05B 19/04; D05B 19/08; D05B 19/16; D05B 39/00; D05B 21/00; D05B 2205/00; D05B 19/10; G05B 2219/2626

USPC ..... 112/103, 102.5, 470.14, 470.18; 700/136, 137, 138

See application file for complete search history.

(56) References Cited

U.S. PATENT DOCUMENTS 478,192 A * 7/1892 Hurzeler ..... 112/90
3,164,112 A * 1/1965 Bono ..... 112/470.09
(Continued)

FOREIGN PATENT DOCUMENTS

EP 1 270 788 A1 1/2003
EP 2 484 827 A1 8/2012
(Continued)

OTHER PUBLICATIONS

Oct. 21, 2014 Extended Search Report issued in European Application No. 14159304.6.
(Continued)

*Primary Examiner* — Ismael Izaguirre
(74) *Attorney, Agent, or Firm* — Oliff PLC

(57) ABSTRACT

A sewing machine includes a frame support portion, a detecting device, a detecting device, a processor, and a memory. The frame support portion is configured to be detachably mounted with a selected one of a plurality of embroidery frames whose types are different from each other. Each of the embroidery frames has a holding portion. The detecting device is configured to detect the type of the embroidery frame mounted on the frame support portion. The memory is configured to store computer-readable instructions that, when executed by the processor, instruct the processor to perform processes comprising, setting a sewing area inside the holding portion, by setting a size of the sewing area, as well as a position and an angle of the sewing area, identifying an embroidery pattern to be sewn on the sewing workpiece, and setting a layout of the identified embroidery pattern, corresponding to the sewing area.

7 Claims, 14 Drawing Sheets

(51) Int. Cl.

| | |
|---|---|
| ***D05C 9/00*** | (2006.01) |
| ***D05C 9/06*** | (2006.01) |

(56) References Cited

U.S. PATENT DOCUMENTS

| | | | | |
|---|---|---|---|---|
| 4,590,695 | A * | 5/1986 | McGillivray | 38/102.2 |
| 4,763,586 | A | 8/1988 | Takenoya et al. | |
| 4,989,525 | A | 2/1991 | Portilla | |
| 5,551,112 | A * | 9/1996 | Brandsma et al. | 12/123 |
| 5,584,799 | A * | 12/1996 | Gray | 602/5 |
| 5,855,176 | A * | 1/1999 | Takenoya et al. | 112/102.5 |
| 6,161,491 | A * | 12/2000 | Takenoya et al. | 112/102.5 |
| 6,336,416 | B1 | 1/2002 | French et al. | |
| 7,178,256 | B2 * | 2/2007 | Roche | 33/653 |
| 7,258,071 | B2 * | 8/2007 | Shoji | 112/470.18 |
| 7,854,207 | B2 * | 12/2010 | Kuki et al. | 112/102.5 |
| 8,028,633 | B2 * | 10/2011 | Naka et al. | 112/103 |
| 2004/0221780 | A1 | 11/2004 | Kawaguchi et al. | |
| 2015/0000574 | A1 * | 1/2015 | Kawaguchi et al. | 112/103 |

FOREIGN PATENT DOCUMENTS

| | | |
|---|---|---|
| JP | A-5-192466 | 8/1993 |
| JP | A-2004-254987 | 9/2004 |

OTHER PUBLICATIONS

Pending U.S. Appl. No. 14/199,012, filed Mar. 6, 2014.
Extended European Search Report issued in European Application No. 14159307.9 issued Jun. 25, 2014.
Partial European Search Report issued in European Application No. 14159304.6 issued Jun. 25, 2014.
Jul. 7, 2015 Office Action issued in European Application No. 14 159 307.9-1710.

* cited by examiner

| ANGLE (DEGREE) | SIZE | ANGLE C (DEGREE) | POSITION |
|---|---|---|---|
| NOT LESS THAN B1 AND LESS THAN B2 | L1, L2 | 45 | (X1, Y1) |
| NOT LESS THAN B2 AND LESS THAN B3 | L1, L2 | 0 | (X1, Y1) |
| NOT LESS THAN B3 | L1, L2 | -45 | (X1, Y1) |

SEWING MACHINE AND EMBROIDERY FRAME

CROSS-REFERENCE TO RELATED APPLICATION

This application claims priority to Japanese Patent Application No. 2013-57948 filed Mar. 21, 2013, the content of which is hereby incorporated herein by reference in its entirety.

BACKGROUND

The present disclosure relates to a sewing machine on which an embroidery frame can be mounted.

A sewing machine that is capable of embroidery sewing performs embroidery sewing while relatively moving a needle and a sewing workpiece that is held by an embroidery frame, based on embroidery data that specifies coordinates of needle drop points. With a sewing machine on which selectively mount one of a plurality of types of embroidery frames can be mounted, it is necessary for the sewing machine to detect the type of the embroidery frame that is mounted on the sewing machine, in order to set a sewing area on the inside of the embroidery frame. To address this, for example, a known sewing machine identifies the type of the embroidery frame by detecting a detection portion of a detection target that is arranged in a position corresponding to the type of the embroidery frame.

SUMMARY

In addition to a normal sheet-like work cloth, sewing workpieces include a tubular work cloth, shoes and the like. There is a demand to perform embroidery sewing on these types of sewing workpieces also. However, with the above-described sewing machine, when embroidery sewing is performed on the aforementioned types of sewing workpieces, it is difficult to perform embroidery sewing due to structural constraints of the sewing machine and the embroidery frame.

Embodiments of the broad principles derived herein provide a sewing machine and an embroidery frame that are capable of embroidery sewing on a variety of sewing workpieces in comparison to related art.

Embodiments provide a sewing machine that includes a frame support portion, a detecting device, a detecting device, a storage device, a processor, and a memory. The frame support portion is configured to be detachably mounted with a selected one of a plurality of embroidery frames whose types are different from each other. Each of the embroidery frames has a holding portion that is configured to hold a sewing workpiece. The detecting device is configured to detect a type of the embroidery frame mounted on the frame support portion. The storage device is configured to store pieces of information about types of the plurality of embroidery frames. Each of the pieces of information indicates the size, the position and the angle of the sewing area for each of the types of the plurality of embroidery frames. The memory configured to store computer-readable instructions that, when executed by the processor, instruct the processor to perform processes comprising setting a sewing area inside the holding portion, by setting a size of the sewing area, as well as a position and an angle of the sewing area with respect to the frame support portion, corresponding to the type of the embroidery frame detected by the detecting device, among the pieces of information about the types of the plurality of embroidery frames that are stored in the storage device, identifying an embroidery pattern to be sewn on the sewing workpiece, and setting a layout of the identified embroidery pattern, corresponding to the sewing area. The sewing area is an area in which stitches can be formed.

Embodiments further provide an embroidery frame that includes a mounting portion and a holding portion. The mounting portion is configured to be detachably mounted on a sewing machine. The holding portion is configured to hold a sewing workpiece. Each of a long side direction and a short side direction of the holding portion is inclined with respect to a long side direction of the mounting portion.

BRIEF DESCRIPTION OF THE DRAWINGS

Embodiments will be described below in detail with reference to the accompanying drawings in which.

DETAILED DESCRIPTION

Hereinafter, an embodiment of the present disclosure will be explained with reference to the drawings. A configuration of a multi-needle sewing machine (hereinafter simply referred to as a sewing machine) 1 according to the embodiment will be explained with reference to FIGS. 1 to 9. In the explanation below, the upper side, the lower side, the lower left side, the upper right side, the upper left side and the lower right side of FIG. 1 respectively correspond to the upper side, the lower side, the front side, the back side, the left side and the right side of the sewing machine 1.

Figure 1:
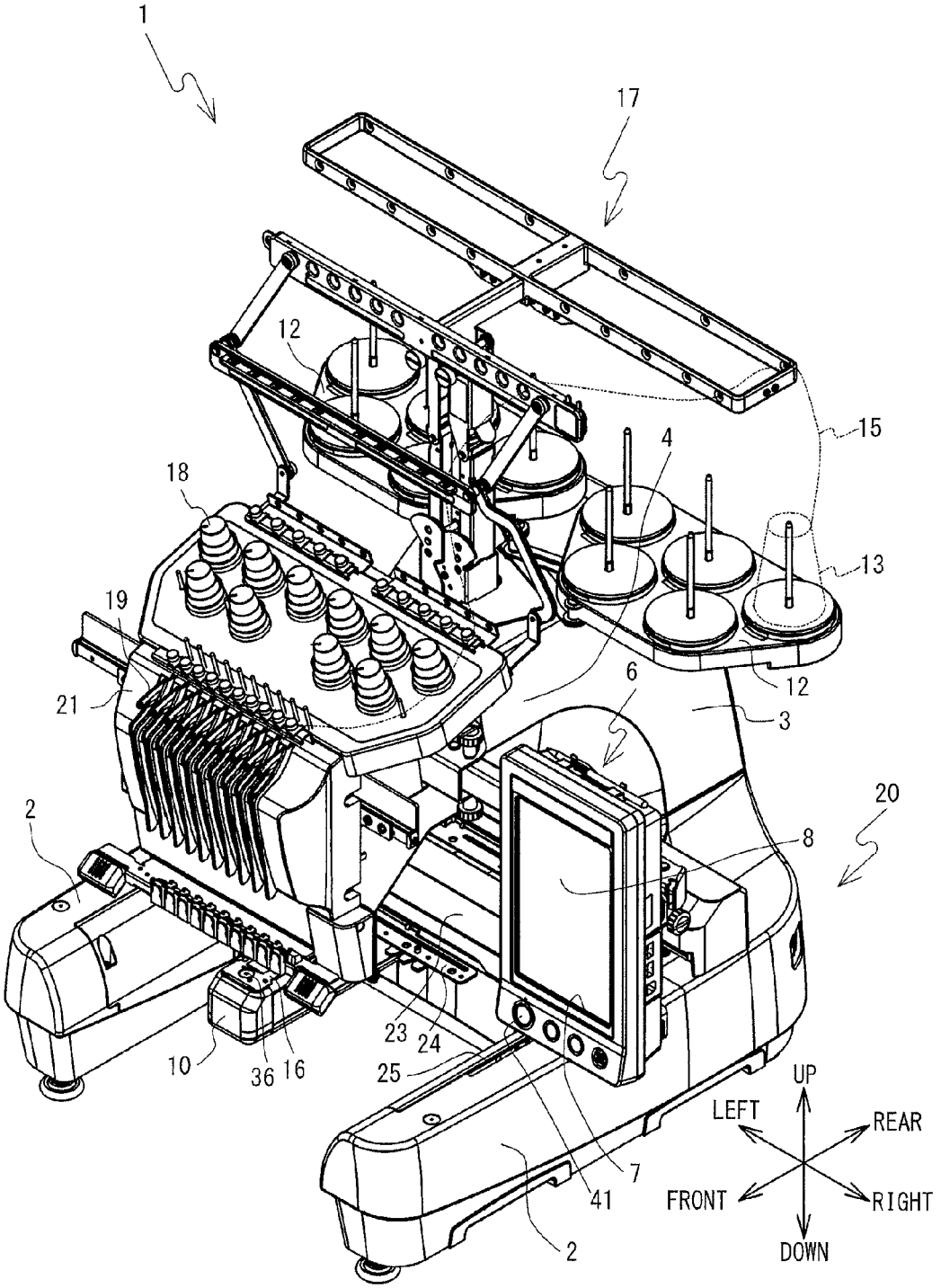
FIG. 1 is a perspective view of a multi-needle sewing machine 1.
Figure 10:
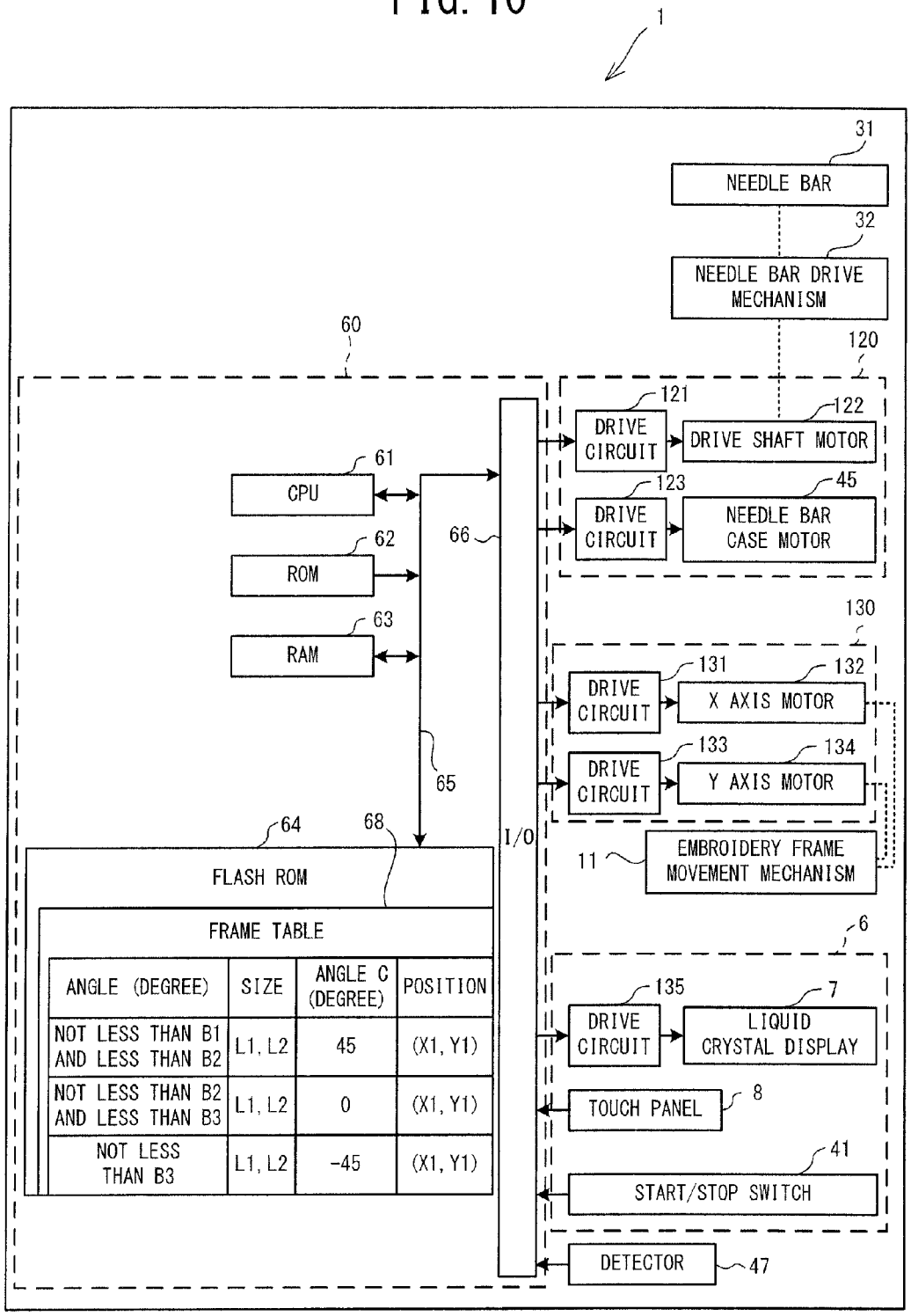
FIG. 10 is a block diagram showing an electrical configuration of the multi-needle sewing machine 1.

As shown in FIG. 1, a main body 20 of the sewing machine 1 is mainly provided with a pair of left and right support portions 2, a pillar 3 and an arm portion 4. The pair of left and right support portions 2 are formed in an inverted U-shape as a whole in a plan view, and supports the whole of the sewing machine 1. A pair of left and right guide grooves 25, which extend in a front-rear direction, are provided in an upper surface of the pair of support portions 2. The pillar 3 is provided so as to extend upward from a rear end portion of the pair of support portions 2. The arm portion 4 extends to the front from an upper end portion of the pillar 3. A needle bar case 21 is attached to the tip end of the arm portion 4 such that the needle bar case 21 can move in a left-right direction. Ten needle bars 31 (refer to FIG. 10), which extend in an up-down direction, are disposed inside the needle bar case 21 at an equal interval in the left-right direction. Of the ten needle bars 31, the needle bar 31 that is in a sewing position is caused to move in the up-down direction by a needle bar drive mechanism 32 (refer to FIG. 10) that is provided inside the needle bar case 21. A needle (not shown in the drawings) is detachably attached to the lower end of each of the needle bars 31.

An operation portion 6 is provided on the right side of a central portion in the front-rear direction of the arm portion 4. The operation portion 6 is provided with a liquid crystal display (LCD) 7, a touch panel 8 and a start/stop switch 41. The LCD 7 may display various types of information, such as operation images used by a user to input a command, for example. The touch panel 8 may be used to receive a command from the user. The user can select or set various types of conditions, such as a sewing pattern and a sewing condition, by performing a pressing operation (this operation is hereinafter referred to as a "panel operation"), using a finger or a stylus pen, on sections of the touch panel 8 that correspond to positions of input keys etc. displayed on the LCD 7. The start/stop switch 41 is a switch that may be used to issue a command to start or stop sewing.

A cylinder-shaped cylinder bed 10, which extends to the front from a lower end portion of the pillar 3, is provided below the arm portion 4. A shuttle (not shown in the drawings) is provided inside a leading end portion of the cylinder bed 10. The shuttle houses a bobbin (not shown in the drawings) on which a bobbin thread (not shown in the drawings) is wound. A shuttle drive mechanism (not shown in the drawings) is provided inside the cylinder bed 10. The shuttle drive mechanism is configured to rotatably drive the shuttle. A needle plate 16, having a rectangular shape in a plan view, is provided on an upper surface of the cylinder bed 10. The needle plate 16 is provided with a needle hole 36 through which the needle (not shown in the drawings) passes.

A pair of left and right thread spool bases 12 are provided on a back surface side of an upper surface of the arm portion 4. The number of thread spools 13 that can be mounted on the pair of the thread spool bases 12 is ten, which is the same as the number of the needle bars 31. A needle thread 15 is supplied from one of the thread spools 13 mounted on the thread spool bases 12. The needle thread 15 is supplied, via a thread guide 17, a tensioner 18, a thread take-up lever 19 and the like, to an eye (not shown in the drawings) of each of the needles attached to the lower end of each of the needle bars 31.

A Y carriage 23 of an embroidery frame movement mechanism 11 (refer to FIG. 10) is supported below the arm portion 4 such that the Y carriage 23 can move in the front-rear direction (Y direction) of the sewing machine 1. The Y carriage 23 extends in the left-right direction, and supports an X carriage 26 (refer to FIG. 2) inside the Y carriage 23 such that the X carriage 26 can move in the left-right direction (X direction) of the sewing machine 1. A holder 24 that is configured to be mounted with an embroidery frame 5 may be attached to the X carriage 26. The embroidery frame movement mechanism 11 is configured to cause the X carriage 26 to move in the left-right direction using an X-axis motor 132 (refer to FIG. 10) as a driving source, and to cause the Y carriage 23 to move in the front-rear direction using a Y axis motor 134 (refer to FIG. 10) as a driving source. With this configuration, the embroidery frame movement mechanism 11 is configured to move the embroidery frame 5, which is mounted on the sewing machine 1 via the holder 24, to a needle drop point that is indicated by an embroidery coordinate system that is specific to the sewing machine 1. The embroidery coordinate system is a coordinate system of the X-axis motor 132 and the Y-axis motor 134 that move the X carriage 26. In the present embodiment, the embroidery coordinate system is defined as follows. The left-right direction of the sewing machine 1 is the X direction, and the direction from the left to the right is an X axis plus direction. The front-rear direction of the sewing machine 1 is the Y direction, and the direction from the front to the rear is a Y axis plus direction.

The embroidery frame 5 will be explained with reference to FIGS. 2 to 5. The embroidery frame 5 is configured to hold the sewing workpiece. A selected one of three types of the embroidery frames 5 can be mounted on the sewing machine 1 of the present embodiment. The three types of the embroidery frames 5 are an embroidery frame 84 shown in FIGS. 2 and 3, an embroidery frame 184 shown in FIG. 4, and an embroidery frame 284 shown in FIG. 5. In the present embodiment, when the embroidery frames 84, 184 and 284 are collectively referred to, they are referred to as the embroidery frames 5. When any one of the embroidery frames 84, 184 and 284 is referred to without being particularly identified, it is referred to as an embroidery frame 5. In the present embodiment, the three types of the embroidery frames 5 are provided with a common holding portion 83. The three types of the embroidery frames 5 are different from each other in the angle in the long side direction of the holding portion 83 with respect to a frame support portion 58 that will be described later. The structure of the embroidery frame 5 in a state in which the embroidery frame 5 is mounted on the sewing machine 1 will be explained in the order of the embroidery frames 84, 184 and 284.

Figure 2:
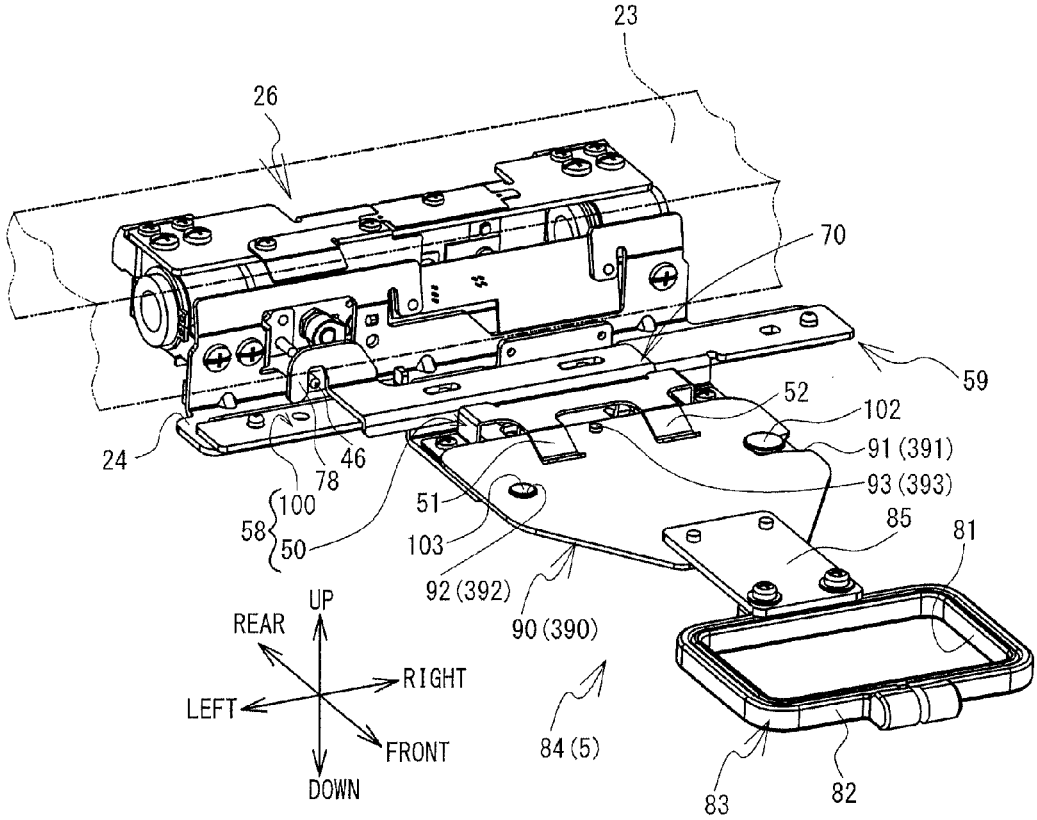
FIG. 2 is a perspective view of an embroidery frame 84 and a frame mounting mechanism 59 on which the embroidery frame 84 is mounted.
Figure 3:
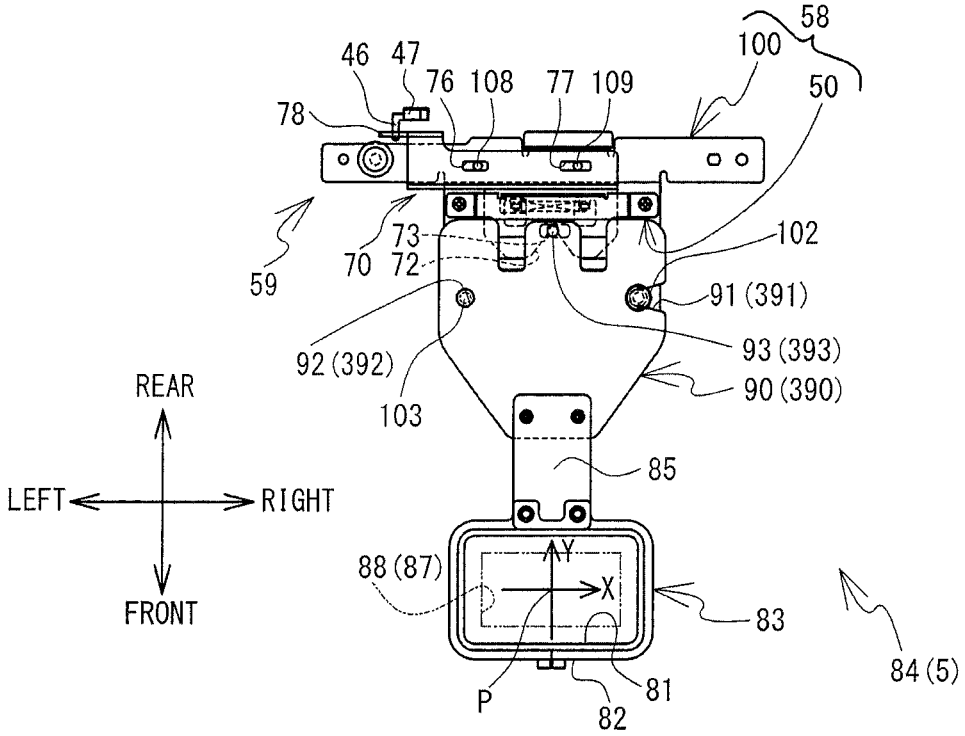
FIG. 3 is a plan view of the embroidery frame 84 that can be mounted on the multi-needle sewing machine 1.

As shown in FIGS. 2 and 3, the embroidery frame 84 mainly includes the holding portion 83, a connecting portion 85 and a mounting portion 90. The holding portion 83 includes an inner frame 81 and an outer frame 82 each having are a rounded rectangular shape in a plan view. The inner periphery of the outer frame 82 has substantially the same shape as the outer periphery of the inner frame 81, and the inner frame 81 is configured to be detachably fitted to the inner side of the outer frame 82. A divided portion that is divided is provided in a central portion of the outer frame 82 in the long side direction. The divided portion is provided with a fastening mechanism that is configured to fasten the outer frame 82 to the inner frame 81. The sewing workpiece may be clamped between the inner frame 81 and the outer frame 82, and may be held such that the sewing workpiece is tightly stretched by the fastening mechanism. A user can change a holding position of the sewing workpiece with respect to the embroidery frame 84 by changing a part of the sewing workpiece that is clamped by the holding portion 83.

The connecting portion 85 is a metal plate member having a rectangular shape in a plan view, and connects the central portion of one of the long sides of the outer frame 82 and a front central portion of the mounting portion 90. The mounting portion 90 is a metal plate member, and may be used to mount the embroidery frame 84 on the frame mounting mechanism 59 of the sewing machine 1. The mounting portion 90 has a specific structure corresponding to the type of the embroidery frame 84. More specifically, the mounting portion 90 is a hexagonal plate member that extends in the horizontal direction. One of the six sides that is on the rear side of the mounting portion 90 and one of the six sides that is on the front side of the mounting portion 90 each extend in the left-right direction. The length of the rear side of the mounting portion 90 is the longest among the six sides of the mounting portion 90. The longest side of the mounting portion 90 extends in the left-right direction. That is, the long side direction of the mounting portion 90 is the left-right direction. The mounting portion 90 is provided with an engagement portion 91, a through hole 92 and a pressing portion 93. The engagement portion 91 is a cutout that is provided in a central portion of the right side (that extends in the front-rear direction) of the mounting portion 90, and is configured to be engaged with an engagement portion 102 of a main body 100 that will be described later. The through hole 92 is a circular hole that is provided in a central portion on the left side of the mounting portion 90, and is configured to be engaged with an engagement portion 103 of the main body 100. The pressing portion 93 has a pin shape that protrudes downward. The position of the pressing portion 93 with respect to the engagement portion 91 is set to a position that is specific to the embroidery frame 84 in order to distinguish between the embroidery frame 84 and the other embroidery frames 5.

In a state in which the embroidery frame 84 is mounted on the sewing machine 1, the inclination of the holding portion 83 in the long side direction with respect to the extension direction of the frame support portion 58 (hereinafter referred to as the "inclination of the holding portion 83") is 0 degrees. The extension direction of the frame support portion 58 of the present embodiment is the left-right direction. In the present embodiment, the inclination with respect to the extension direction of the frame support portion 58 is defined such that an angle in the clockwise direction with respect to the extension direction of the frame support portion 58 is a plus angle and an angle in the counterclockwise direction with respect to the extension direction of the frame support portion 58 is a minus angle. The extension direction of the frame support portion 58 is the same as the extension direction of the Y carriage 23 and the X carriage 26. The extension direction of the frame support portion 58 is the same as the direction in which the X carriage 26 is moved by the X-axis motor 132 (refer to FIG. 10) as a driving source. The extension direction of the frame support portion 58 is the same as the extension direction of the longest side of the mounting portion 90.

Figure 4:
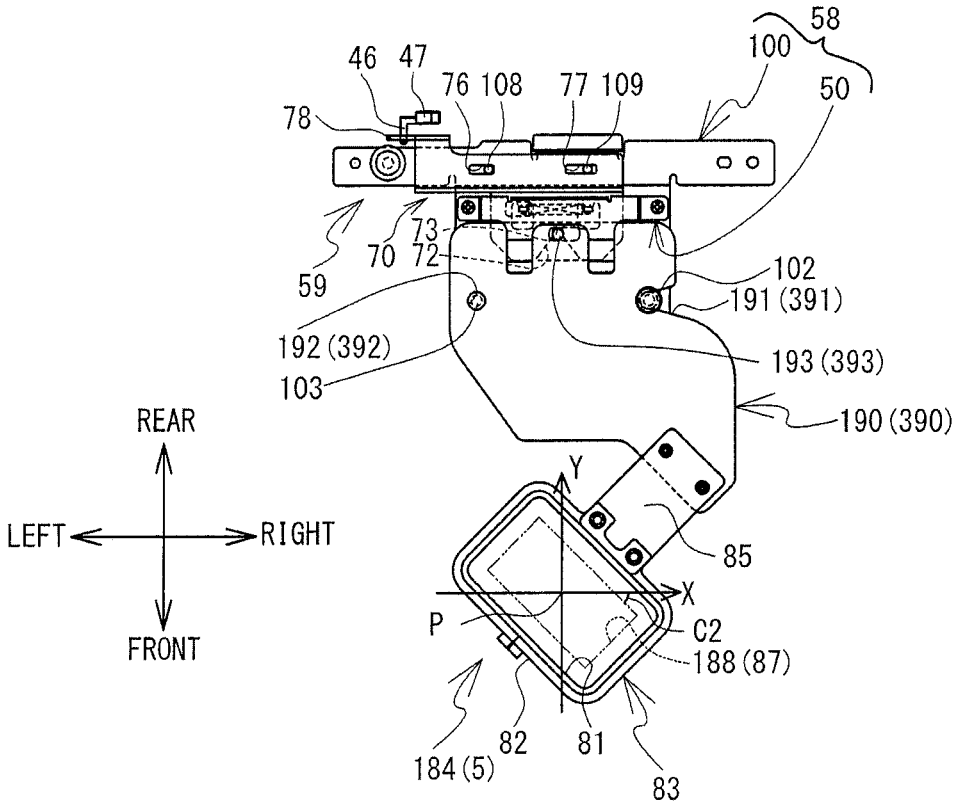
FIG. 4 is a plan view of an embroidery frame 184 that can be mounted on the multi-needle sewing machine 1.

The inclination (an angle C2) of the holding portion 83 of the embroidery frame 184 shown in FIG. 4 is 45 degrees. The embroidery frame 184 has the holding portion 83, the connecting portion 85 and a mounting portion 190. The holding portion 83 and the connecting portion 85 of the embroidery frame 184 are the same as the holding portion 83 and the connecting portion 85 of the embroidery frame 84. The mounting portion 190 is a plate member that extends in the horizontal direction. The shape of the mounting portion 190 is different from the shape of the mounting portion 90 and also different from the shape of a mounting portion 290. The mounting portion 190 is formed such that a right front portion of the mounting portion 190 protrudes further toward the front than a right front portion of the mounting portion 90. The rear side of the mounting portion 190 extends in the left-right direction. The length of the rear side of the mounting portion 190 is the longest among a plurality of sides of the mounting portion 190. The longest side of the mounting portion 190 extends in the left-right direction. That is, the long side direction of the mounting portion 190 is the left-right direction. The connecting portion 85 connects the central portion of the one of the long sides of the outer frame 82 and the right front portion of the mounting portion 190, and the inclination of the holding portion 83 is set to 45 degrees. Each of the long side direction and the short side direction of the holding portion 83 of the embroidery frame 184 is inclined with respect to the long side direction of the mounting portion 190. Each of the long side direction and the short side direction of the holding portion 83 of the embroidery frame 184 is inclined with respect to the extension direction of the longest side of the mounting portion 190. The mounting portion 190 is provided with an engagement portion 191, a through hole 192 and a pressing portion 193. The engagement portion 191 is a cutout that is provided in a central portion of the right side (that extends in the front-rear direction) of the mounting portion 190, and is configured to be engaged with the engagement portion 102 of the main body 100 that will be described later. The through hole 192 is a circular hole that is provided in a central portion on the left side of the mounting portion 190, and is configured to be engaged with the engagement portion 103 of the main body 100. The pressing portion 193 has a pin shape that protrudes downward. The position of the pressing portion 193 with respect to the engagement portion 191 is set to a position that is specific to the embroidery frame 184 in order to distinguish between the embroidery frame 184 and the other embroidery frames 5.

Figure 5:
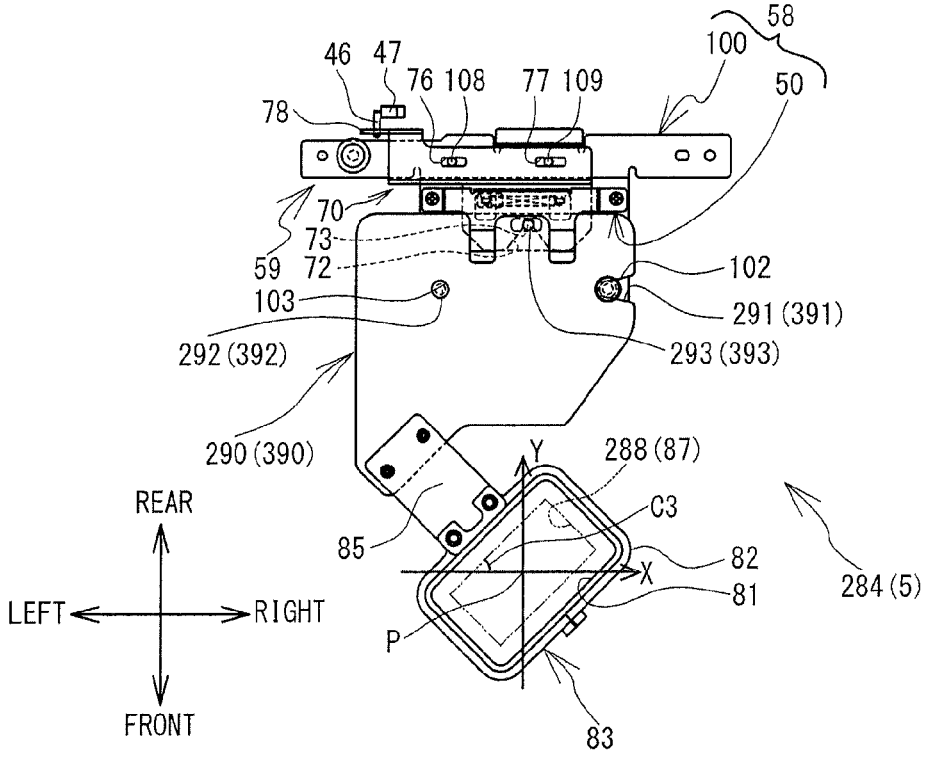
FIG. 5 is a plan view of an embroidery frame 284 that can be mounted on the multi-needle sewing machine 1.
Figure 6:
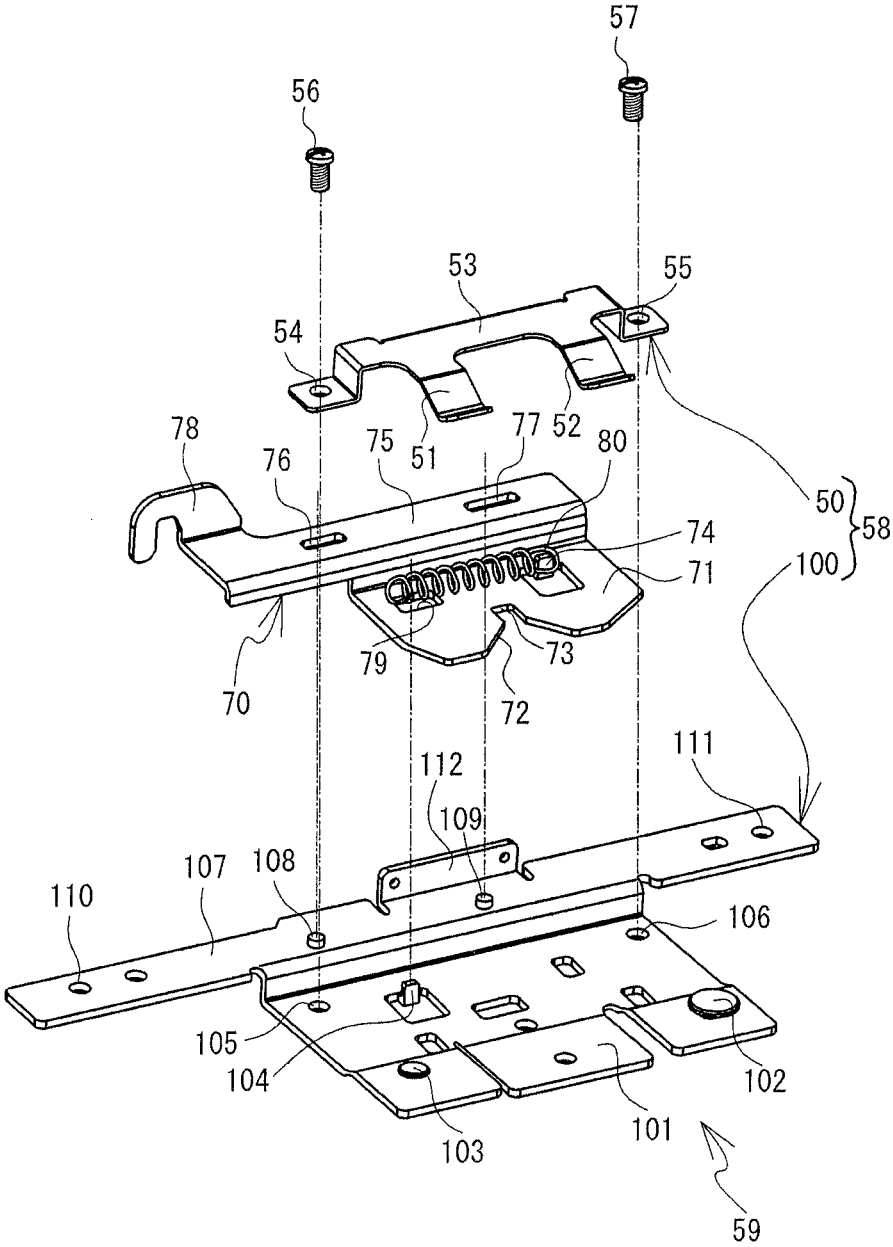
FIG. 6 is an exploded perspective view of the frame mounting mechanism 59.

The inclination (an angle C3) of the holding portion 83 of the embroidery frame 284 shown in FIG. 5 is −45 degrees. The embroidery frame 284 has the holding portion 83, the connecting portion 85 and the mounting portion 290. The holding portion 83 and the connecting portion 85 of the embroidery frame 284 are the same as the holding portion 83 and the connecting portion 85 of the embroidery frame 84. The mounting portion 290 is a plate member that extends in the horizontal direction. The shape of the mounting portion 290 is different from the shape of the mounting portion 90 and also different from the shape of the mounting portion 190. The mounting portion 290 is formed such that a left front portion of the mounting portion 290 protrudes further toward the front than a left front portion of the mounting portion 90. The rear side of the mounting portion 290 extends in the left-right direction. The length of the rear side of the mounting portion 290 is the longest among a plurality of sides of the mounting portion 290. The longest side of the mounting portion 290 extends in the left-right direction. That is, the long side direction of the mounting portion 290 is left-right direction. The connecting portion 85 connects the central portion of the one of the long sides of the outer frame 82 and the left front portion of the mounting portion 290, and the inclination of the holding portion 83 is set to −45 degrees. Each of the long side direction and the short side direction of the holding portion 83 of the embroidery frame 284 is inclined with respect to the long side direction of the mounting portion 290. Each of the long side direction and the short side direction of the holding portion 83 of the embroidery frame 284 is inclined with respect to the extension direction of the longest side of the mounting portion 290. The mounting portion 290 is provided with an engagement portion 291, a through hole 292 and a pressing portion 293. The engagement portion 291 is a cutout that is provided in a central portion of the right side (that extends in the front-rear direction) of the mounting portion 290, and is configured to be engaged with the engagement portion 102 of the main body 100 that will be described later. The through hole 292 is a circular hole that is provided in a central portion on the left side of the mounting portion 290, and is configured to be engaged with the engagement portion 103 of the main body 100. The pressing portion 293 has a pin shape that protrudes downward. The position of the pressing portion 293 with respect to the engagement portion 291 is set to a position that is specific to the embroidery frame 284 in order to distinguish between the embroidery frame 284 and the other embroidery frames 5.

Hereinafter, when the mounting portions 90, 190 and 290 are collectively referred to, they are referred to as mounting portions 390. When any one of the mounting portions 90, 190 and 290 is referred to without being particularly identified, it is referred to as a mounting portion 390. When the engagement portions 91, 191 and 291 are collectively referred to, they are referred to as engagement portions 391. When any one of the engagement portions 91, 191 and 291 is referred to without being particularly identified, it is referred to as an engagement portion 391. When the through holes 92, 192 and 292 are collectively referred to, they are referred to as through holes 392. When any one of the through holes 92, 192 and 292 is referred to without being particularly identified, it is referred to as a through hole 392. When the pressing portions 93, 193 and 293 are collectively referred to, they are referred to as pressing portions 393. When any one of the pressing portions 93, 193 and 293 is referred to without being particularly identified, it is referred to as a pressing portion 393. Based on the inclination of the holding portion 83, the embroidery frames 84, 184 and 284 are also referred to as a 0 degree frame, a 45 degree frame and a −45 degree frame, respectively.

The frame mounting mechanism 59 will be explained with reference to FIGS. 2 to 6. The frame mounting mechanism 59 is a mechanism configured to detachably mount a selected one of the plurality of types of the embroidery frames 5 on the sewing machine 1. The frame mounting mechanism 59 is configured to detect the type of the embroidery frame 5 that is mounted on the sewing machine 1. The frame mounting mechanism 59 mainly includes the frame support portion 58 and a switching plate 70.

The mounting portion 390 of the embroidery frame 5 that is configured to hold the sewing workpiece is configured to be detachably mounted on the frame support portion 58. A selected one of the embroidery frames 84, 184 and 284 can be mounted on the frame support portion 58. In each of the embroidery frames 184 and 284, the long side direction of the rectangular holding portion 83 is inclined by a predetermined angle with respect to the extension direction of the frame support portion 58.

The frame support portion 58 mainly includes the main body 100 and a frame retainer plate 50. The main body 100 is a plate member that extends in the left-right direction, and has a support plate portion 101, a mounting plate portion 107 and a guide plate portion 112. The support plate portion 101 is a plate-like portion that extends in the horizontal direction on the front side of the main body 100. The support plate portion 101 is provided with the engagement portions 102 and 103, a support portion 104 and screw holes 105 and 106. Each of the engagement portions 102 and 103 is a convex portion that protrudes upward and has a circular shape in a plan view. The engagement portions 102 and 103 are configured to be respectively engaged with the engagement portion 391 and the through hole 392 that are provided in the embroidery frame 5. The support portion 104 is a portion that protrudes upward from the top surface of the support plate portion 101. The support portion 104 is inserted through a through hole 79 of the switching plate 70, and is configured to support the left end of an urging member 80. The urging member 80 of the present embodiment is a coil spring. The right end of the urging member 80 is supported by the switching plate 70 that will be described later. The screw holes 105 and 106 are respectively engaged with screws 56 and 57 that are used to fix the frame retainer plate 50 to the main body 100.

The mounting plate portion 107 is a plate-like portion that extends in the left-right direction. The mounting plate portion 107 is a portion that is configured to fix the frame mounting mechanism 59 to the holder 24 of the X carriage 26, and that is configured to guide the movement of the switching plate 70. The mounting plate portion 107 is provided with a pair of left and right guide pins 108 and 109 and screw holes 110 and 111. The guide pins 108 and 109 protrude upward from the top surface of the mounting plate portion 107. The guide pins 108 and 109 are respectively inserted through elongated holes 76 and 77 of the switching plate 70, and are configured to regulate the movement direction of the switching plate 70 together with the elongated holes 76 and 77. The screw holes 110 and 111 are engaged with screws (not shown in the drawings) that are used to fix the frame mounting mechanism 59 to the holder 24. The guide plate portion 112 is a plate-like portion that extends upward from a central portion of the rear edge of the mounting plate portion 107, and is configured to regulate the movement direction of the switching plate 70.

The frame retainer plate 50 is a member that is configured to hold down the mounting portion 390 of the embroidery frame 5 mounted on the frame mounting mechanism 59, from above. The frame retainer plate 50 is provided with a pair of left and right retaining portions 51 and 52, a main body 53 and a pair of left and right screw holes 54 and 55. The retaining portions 51 and 52 extend to the front from the main body 53, and are configured to hold down the mounting portion 390 of the embroidery frame 5 mounted on the frame mounting mechanism 59, from above. The frame retainer plate 50 is fixed to the main body 100 by the screws 56 and 57 that are inserted through the screw holes 54 and 55, respectively.

The switching plate 70 is a movable member that is configured to move in a first direction in conjunction with an operation to mount the mounting portion 390 of the embroidery frame 5 on the frame support portion 58. The amount of movement of the switching plate 70 is set corresponding to the type of the embroidery frame 5. The first direction of the present embodiment is the rightward direction. The switching plate 70 has a first plate portion 71, a second plate portion 75 and an engagement portion 78.

The first plate portion 71 is a plate-like portion that extends in the horizontal direction on the front side of the switching plate 70. The first plate portion 71 is disposed above the support plate portion 101 of the main body 100 and below the frame retainer plate 50. The first plate portion 71 has a first contact portion 72, a second contact portion 73, a support portion 74 and the through hole 79. The first contact portion 72 is a large inverted V-shaped cut out portion formed on the front edge of the first plate portion 71 in a plan view. The first contact portion 72 is configured to guide the pressing portion 393 of the embroidery frame 5 to the second contact portion 73. The second contact portion 73 is a portion that is configured to come into contact with and holds the pressing portion 393 of the embroidery frame 5 when the embroidery frame 5 is mounted on the sewing machine 1. The second contact portion 73 forms a concave portion that is slightly larger than the diameter of the pin-shaped pressing portion 393. The support portion 74 is a portion that protrudes upward from the top surface of the first plate portion 71, and is configured to support the right end of the urging member 80. The switching plate 70 is urged by the urging member 80 in a second direction that is a direction opposite to the first direction. In the present embodiment, the first direction is the rightward direction and the second direction is the leftward direction.

The second plate portion 75 is a plate-like portion that extends in the left-right direction, and is provided with the pair of left and right elongated holes 76 and 77. The elongated holes 76 and 77 each extend in the left-right direction. The guide pins 108 and 109 are inserted through the elongated holes 76 and 77, respectively. The engagement portion 78 is a portion that has a hook-like shape and that extends upward from the left rear end of the second plate portion 75. The engagement portion 78 is configured to be engaged with a detecting element 46 of a detector 47. The detector 47 is a rotary potentiometer. The detecting element 46 rotates corresponding to the amount of movement of the switching plate 70. Therefore, the detector 47 can detect the amount of movement of the switching plate 70 based on the amount of rotation of the detecting element 46.

Figure 7:
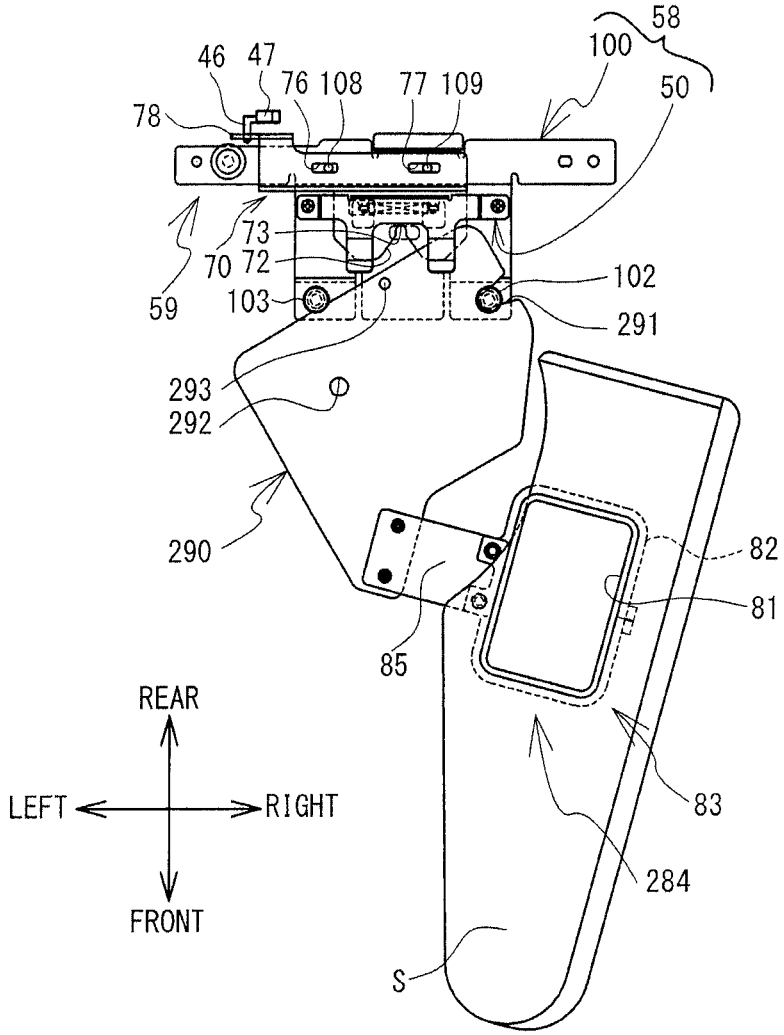
FIG. 7 is a plan view showing a process of mounting the embroidery frame 284, which holds a shoe S, on a frame support portion 58 of the multi-needle sewing machine 1.
Figure 8:
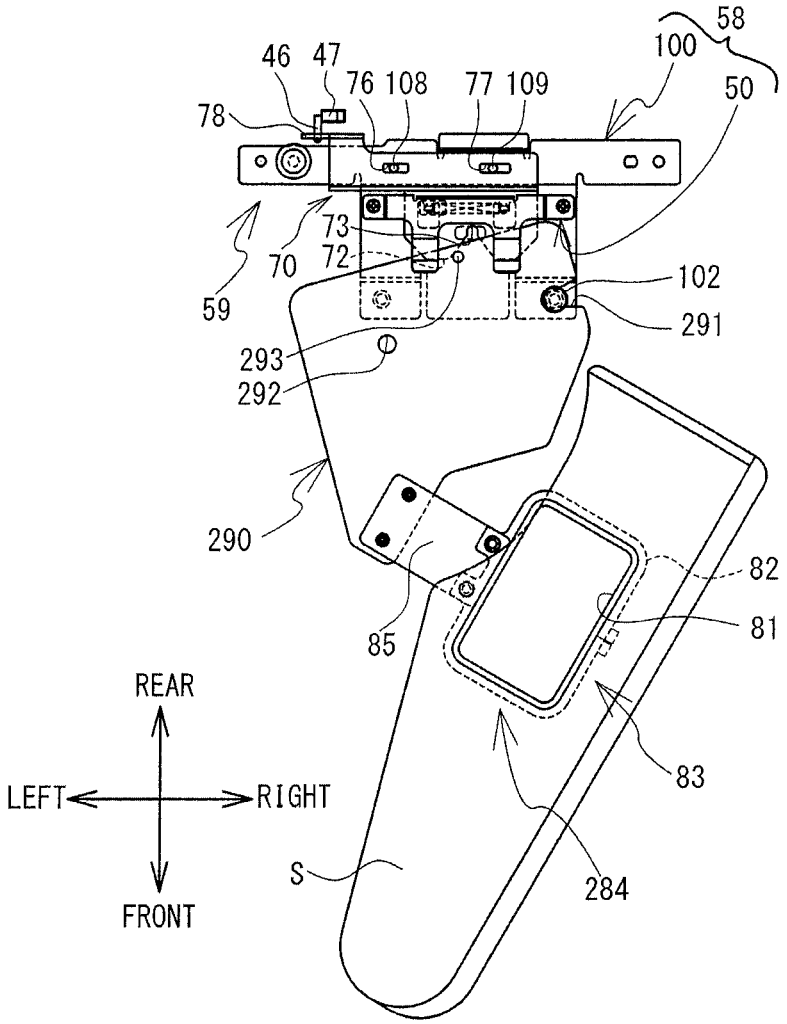
FIG. 8 is a plan view showing a process of mounting the embroidery frame 284, which holds the shoe S, on the frame support portion 58 of the multi-needle sewing machine 1.

Operations to mount the embroidery frame 5 on the sewing machine 1 will be explained. As an example, a case will be explained in which the embroidery frame 284 is mounted on the frame support portion 58 in a state in which the holding portion 83 holds a side surface of the shoe S such that the long sides of the holding portion 83 are substantially in parallel with a shoe bottom or a shoe opening of the shoe S, which is the sewing workpiece. As shown in FIG. 7, first, the user may engage the engagement portion 102 of the main body 100 with the engagement portion 291 provided on the mounting portion 290 of the embroidery frame 284. At this time, the side that is on the rear side (the longest side) of the mounting portion 290 is inclined with respect to the extension direction (left-right direction) of the frame support portion 58. In a state in which the engagement portion 102 is engaged with the engagement portion 291, the user may rotate the embroidery frame 284 in the clockwise direction in a plan view around the engagement portion 102. As a result, as shown in FIG. 8, the pressing portion 293 of the mounting portion 290 comes into contact with the first contact portion 72, and moves toward the second contact portion 73 while being guided by the first contact portion 72. The pressing portion 293 comes into contact with the first contact portion 72 while pressing the first contact portion 72. The switching plate 70 moves in the first direction when the first contact portion 72 is pressed in the first direction by the pressing portion 293 against the urging force of the urging member 80. The amount of movement of the switching plate 70 is determined in accordance with the position of the pressing portion 293 with respect to the engagement portion 291.

Figure 9:
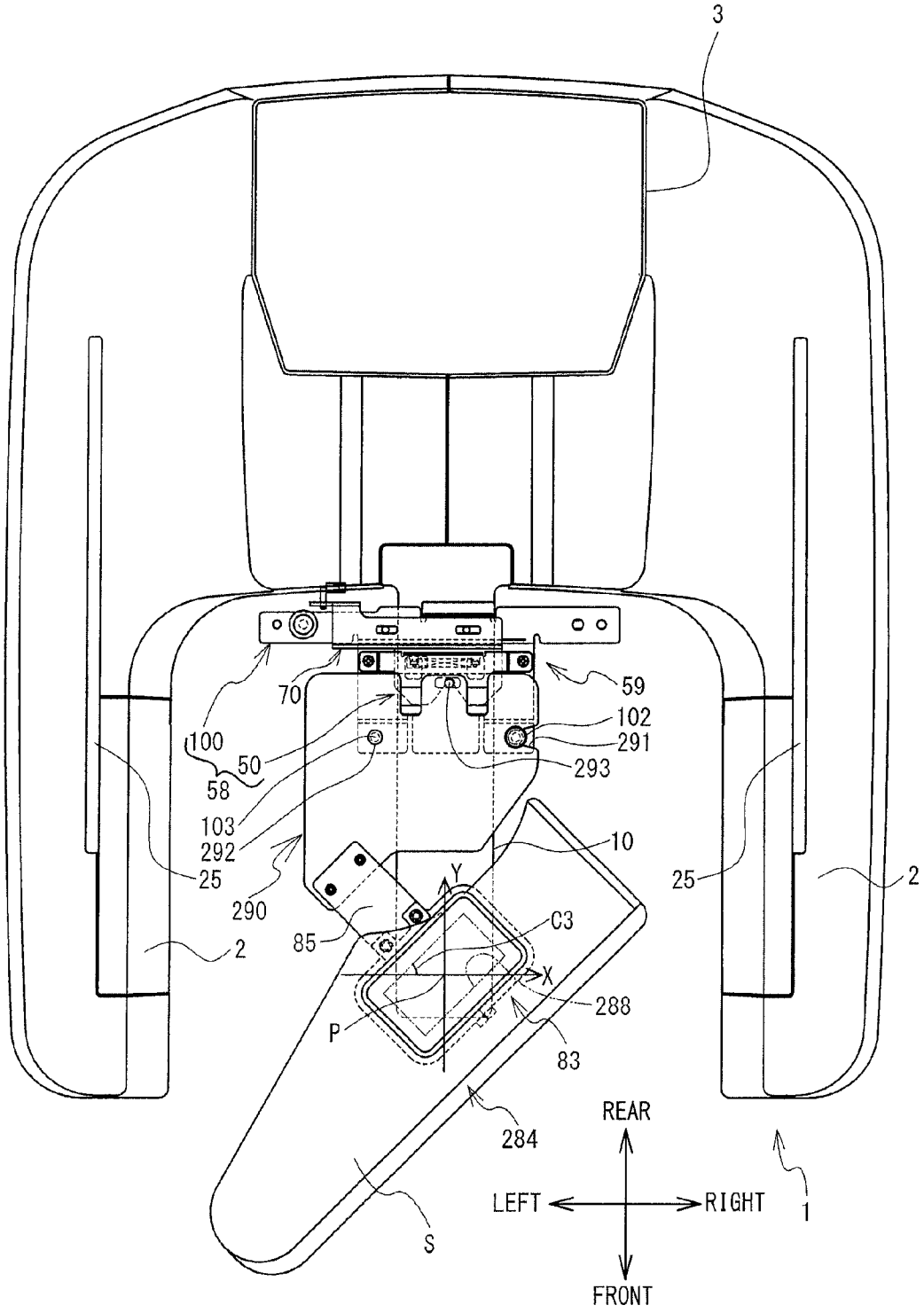
FIG. 9 is a plan view showing a positional relationship between the shoe S and support portions 2 in a state in which the embroidery frame 284 that holds the shoe S is mounted on the frame support portion 58 of the multi-needle sewing machine 1.

When the user further rotates the embroidery frame 284 in the clockwise direction in a plan view, the pressing portion 293 is guided by the first contact portion 72 to the second contact portion 73, and is accommodated in the second contact portion 73. When the user further rotates the embroidery frame 284 in the clockwise direction in a plan view, the through hole 292 and the engagement portion 103 engage with each other, as shown in FIG. 9. Thus, the rotation of the embroidery frame 284 is regulated and the position of the embroidery frame 284 in the horizontal direction is fixed. At this time, the side that is on the rear side of the mounting portion 290 is parallel to the extension direction of the frame support portion 58. The mounting portion 290 is held down from above by the frame retainer plate 50, and is clamped by the frame retainer plate 50 and the main body 100. As a result, the position of the mounting portion 290 in the up-down direction is fixed. With the above-described operations, the embroidery frame 284 is mounted on the sewing machine 1. When the embroidery frame 284 is removed from the sewing machine 1, operations opposite to those described above are performed. As shown in FIG. 9, when the embroidery frame 284 is mounted on the frame mounting mechanism 59, the shoe bottom of the shoe S is arranged to be inclined with respect to the extension direction of the frame support portion 58, and the shoe S is arranged between the pair of left and right support portions 2.

A method for detecting the type of the embroidery frame 5 will be explained. In the mounting portion 390 of the embroidery frame 5 of the present embodiment, the position of the pressing portion 393 with respect to the engagement portion 391 differs in accordance with the type of the embroidery frame 5. Therefore, the amount of movement of the switching plate 70 in the first direction varies in accordance with the position of the pressing portion 393 with respect to the engagement portion 391. The engagement portion 78 of the switching plate 70 is engaged with the detecting element 46 of the detector 47. When the switching plate 70 moves, the detecting element 46 rotates. The amount of rotation of the detecting element 46 is different depending on whether the embroidery frame 84 is mounted on the sewing machine 1, whether the embroidery frame 184 is mounted on the sewing machine 1, or whether the embroidery frame 284 is mounted on the sewing machine 1. The detector 47 can detect the type of the embroidery frame 5 by detecting the amount of rotation of the detecting element 46.

Figure 13:
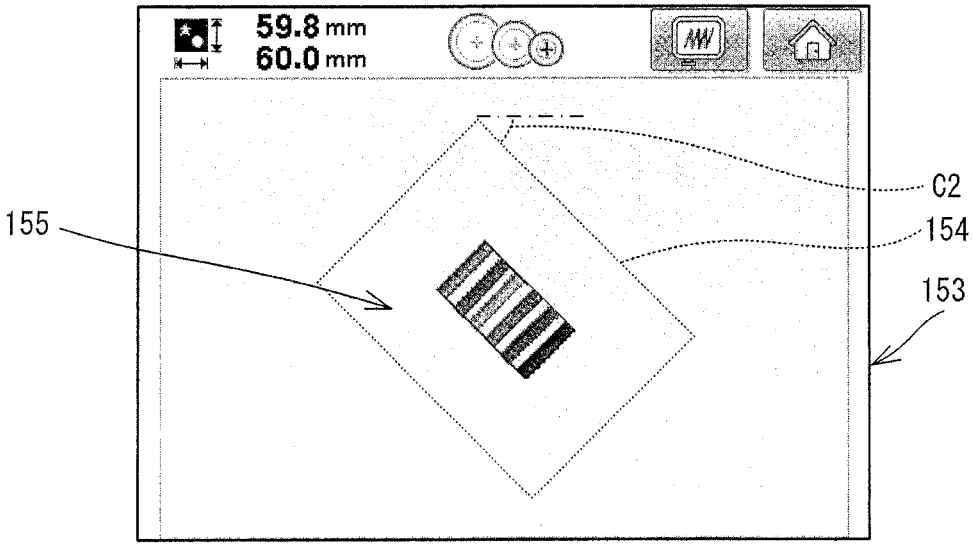
FIG. 13 is an explanatory diagram of a screen 153 that is displayed on the LCD 7.

An electrical configuration of the sewing machine 1 will be explained with reference to FIG. 13. As shown in FIG. 13, the sewing machine 1 is provided with a needle drive portion 120, a sewing target drive portion 130, the operation portion 6, a control portion 60 and the detector 47.

The needle drive portion 120 is provided with a drive shaft motor 122, a drive circuit 121, a needle bar case motor 45, and a drive circuit 123. The drive shaft motor 122 causes the needle bar 31 to move in the up-down direction. The drive circuit 121 may drive the drive shaft motor 122 in accordance with a control signal from the control portion 60. The needle bar case motor 45 causes the needle bar case 21 to move in the left-right direction. The drive circuit 123 may drive the needle bar case motor 45 in accordance with a control signal from the control portion 60.

The sewing target drive portion 130 is provided with the X-axis motor 132, a drive circuits 131, the Y-axis motor 134, and a drive circuits 133. The X-axis motor 132 may drive the embroidery frame movement mechanism 11 and thereby causes the embroidery frame 5 (refer to FIG. 2) to move in the left-right direction. The drive circuit 131 may drive the X-axis motor 132 in accordance with a control signal from the control portion 60. The Y-axis motor 134 may drive the embroidery frame movement mechanism 11 and thereby causes the embroidery frame 5 to move in the front-rear direction. The drive circuit 133 may drive the Y-axis motor 134 in accordance with a control signal from the control portion 60.

The operation portion 6 is provided with the touch panel 8, a drive circuit 135, the LCD 7 and the start/stop switch 41. The drive circuit 135 may drive the LCD 7 in accordance with a control signal from the control portion 60.

The control portion 60 is provided with the CPU 61, a ROM 62, a RAM 63, a flash ROM 64 and an input/output (I/O) interface 66, and they are mutually connected by a signal line 65. The needle drive portion 120, the sewing target drive portion 130, the operation portion 6 and the detector 47 are respectively connected to the I/O interface 66.

The CPU 61 performs main control of the sewing machine 1. The CPU 61 performs various operations and processing that relate to sewing, in accordance with various programs stored in a program storage area (not shown in the drawings) of the ROM 62. Although not shown in the drawings, the ROM 62 is provided with a plurality of storage areas including the program storage area and a pattern storage area. Various programs to operate the sewing machine 1, including a main program, are stored in the program storage area. The main program is a program to perform main processing. In the main processing, processing is performed in which a sewing area 87 is set inside the inner frame 81 corresponding to the type of the embroidery frame 5 that has been mounted on the frame support portion 58. In the main processing, processing is further performed in which the pattern selected by the user is arranged in accordance with settings of the sewing area 87 and sewing is performed on the sewing workpiece held by the embroidery frame 5. The RAM 63 includes, as necessary, a storage area to store operation results etc. processed by the CPU 61. The flash ROM 64 stores various parameters including a frame table 68 that are used for the sewing machine 1 to perform various types of processing.

The frame table 68 stores corresponding relationships between the angle (degree) of the detecting element 46 shown by an output result of the detector 47 and the settings of the sewing area 87 that corresponds to the type of the embroidery frame 5. That is, the frame table 68 stores pieces of information about the size, the position and the angle of the sewing area 87. The pieces of information correspond to the plurality of embroidery frames 5, respectively. The settings of the sewing area 87 that corresponds to the type of the embroidery frame 5 of the present embodiment include the size of the sewing area 87, the angle (degree) of the sewing area 87 in the long side direction with respect to the extension direction of the frame support portion 58, and the position of the sewing area 87 with respect to the frame support portion 58. The sewing area 87 is an area which is set inside the inner frame 81 and in which stitches can be formed. The sewing area 87 of the present embodiment has a rectangular shape, and the size of the sewing area 87 is represented by the length of the shorter sides and the length of the longer sides. The angle (degree) of the sewing area 87 in the long side direction with respect to the extension direction of the frame support portion 58 is set to match the angle (degree) of the holding portion 83 in the long side direction with respect to the extension direction of the frame support portion 58. The position of the sewing area 87 with respect to the frame support portion 58 is represented by the amount of movement of the embroidery frame 5 when the needle drop point is set to the position of the center point of the sewing area 87. The CPU 61 performs the main processing based on the output result of the detector 47 and the frame table 68.

Processing that is performed by the sewing machine 1 of the present embodiment will be explained with reference to FIGS. 11 to 14. The main processing is started when the user inputs a command to start the main processing by operating the touch panel 8. When the input of the command to start the main processing is detected, the CPU 61 of the sewing machine 1 reads the program, which is stored in the flash ROM 64 (refer to FIG. 10) in order to perform the main processing, into the RAM 63, and performs processing at each step (which will be explained below) in accordance with instructions included in the program. In the present embodiment, before the user causes the sewing machine 1 to perform the main processing, the user mounts the embroidery frame 5 holding the sewing workpiece onto the frame support portion 58.

Figure 11:
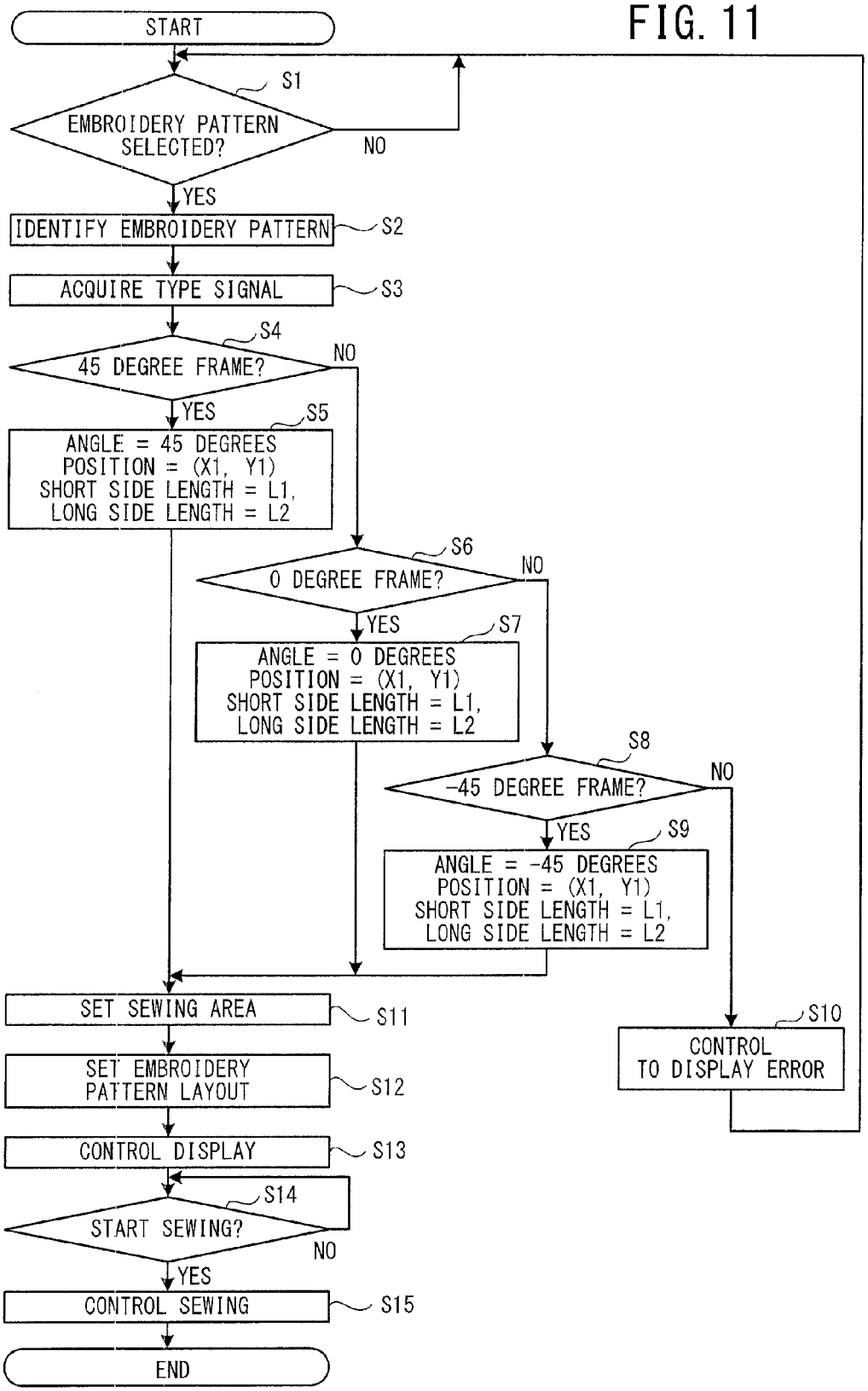
FIG. 11 is a flowchart of main processing.
Figure 12:
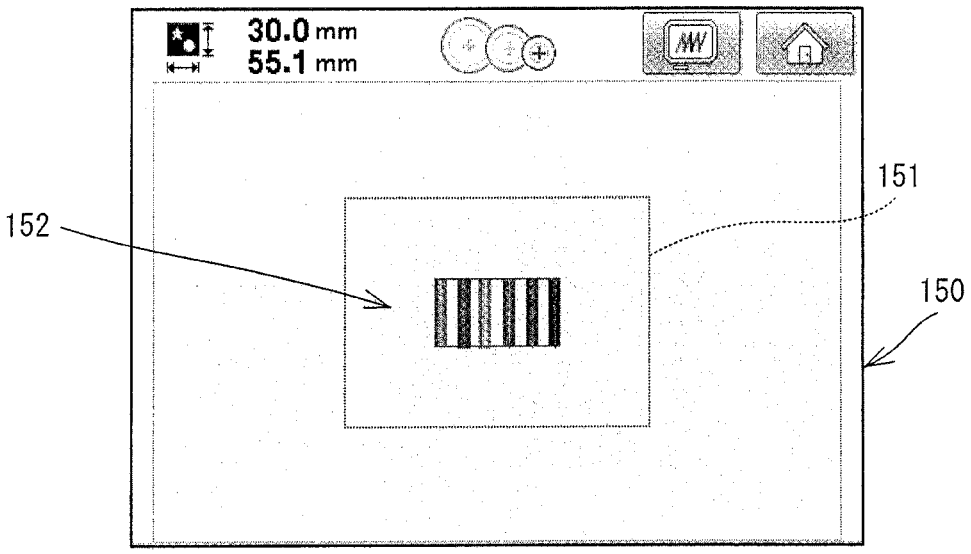
FIG. 12 is an explanatory diagram of a screen 150 that is displayed on an LCD 7.

As shown in FIG. 11, in the main processing, first, the CPU 61 accepts selection of an embroidery pattern, which is a target pattern to be sewn (step S1). Specifically the CPU 61 causes the LCD 7 (refer to FIG. 1) to display, for example, a screen that shows a plurality of embroidery patterns for which pattern data is stored in the flash ROM 64. The CPU 61 waits until the CPU 61 detects that the user has selected one of the displayed embroidery patterns (no at step S1). When the CPU 61 detects that the user has selected one of the displayed embroidery patterns through the panel operation (yes at step S1), the CPU 61 identifies the selected embroidery pattern as the target pattern (step S2). The CPU 61 acquires a type signal that is output from the detector 47.

The CPU 61 sets the sewing area 87 based on information that corresponds to the type of the embroidery frame 5 indicated by the type signal acquired at step S3. Specifically, when the CPU 61 determines that the amount of rotation of the detecting element 46 is not less than B1 and less than B2 based on the type signal acquired at step S3, the CPU 61 determines that the embroidery frame 5 mounted on the frame support portion 58 is the embroidery frame 184 (the 45 degree frame) shown in FIG. 4 (yes at step S4). In this case, the CPU 61 sets the sewing area 87 in the following manner. The CPU 61 sets the angle of the sewing area 87 to 45 degrees, sets the position of the sewing area 87 to (X1, Y1), sets the length of the short sides of the sewing area 87 to L1, and sets the length of the long sides of the sewing area 87 to L2.

When the amount of rotation of the detecting element 46 that is indicated by the type signal acquired at step S3 is not less than B2 and less than B3, the CPU 61 determines that the embroidery frame 5 mounted on the frame support portion 58 is the embroidery frame 84 (the 0 degree frame) shown in FIGS. 2 and 3 (no at step S4, yes at step S6). In this case, the CPU 61 sets the sewing area 87 in the following manner. The CPU 61 sets the angle of the sewing area 87 to 0 degrees, sets the position of the sewing area 87 to (X1, Y1), sets the length of the short sides of the sewing area 87 to L1, and sets the length of the long sides of the sewing area 87 to L2.

When the amount of rotation of the detecting element 46 that is indicated by the type signal acquired at step S3 is not less than B3, the CPU 61 determines that the embroidery frame 5 mounted on the frame support portion 58 is the embroidery frame 284 (the −45 degree frame) shown in FIG. 5 (no at step S4, no at step S6, yes at step S8). In this case, the CPU 61 sets the sewing area 87 in the following manner. The CPU 61 sets the angle of the sewing area 87 to −45 degrees, sets the position of the sewing area 87 to (X1, Y1), sets the length of the short sides of the sewing area 87 to L1, and sets the length of the long sides of the sewing area 87 to L2. When the amount of rotation of the detecting element 46 that is indicated by the type signal acquired at step S3 is less than B1 (no at step S4, no at step S6, no at step S8), the CPU 61 determines that the type of the embroidery frame 5 mounted on the frame support portion 58 cannot be detected. The CPU 61 controls the drive circuit 135 and causes the LCD 7 to display an error message (step S10), and returns the processing to step S1. The error message is, for example, "This frame cannot be used."

After the processing at step S5, step S7 or step S9, the CPU 61 sets the area on the inside of the holding portion 83 as the sewing area 87 in which stitches can be formed, corresponding to the type of the embroidery frame 5 indicated by the type signal acquired at step S3 (step S11). Corresponding to the type of the embroidery frame 5, the CPU 61 sets the size of the sewing area 87 and the position and angle of the sewing area 87 with respect to the frame support portion 58. Specifically, the CPU 61 sets the sewing area 87 based on the values set at step S5, step S7 or step S9.

When the embroidery frame 5 is the embroidery frame 84 (the 0 degree frame), a sewing area 88 is set inside the inner frame 81, as shown in FIG. 3, by the processing at step S11. The long side direction of the rectangular sewing area 88 is parallel to the extension direction of the frame support portion 58. That is, the angle of the rectangular sewing area 88 in the long side direction with respect to the extension direction of the frame support portion 58 is 0 degrees. The central position of the sewing area 88 is (X1, Y1), and an origin P of the embroidery coordinate system is set to this position. The length of the short sides of the sewing area 88 is L1 and the length of the long sides of the sewing area 88 is L2.

When the embroidery frame 5 is the embroidery frame 184 (the 45 degree frame), a sewing area 188 is set inside the inner frame 81, as shown in FIG. 4. The angle C2 formed between the long side direction of the rectangular sewing area 188 and the extension direction of the frame support portion 58 is 45 degrees. The central position of the sewing area 188 is (X1, Y1), and the origin P of the embroidery coordinate system is set to this position. The length of the short sides of the sewing area 188 is L1 and the length of the long sides of the sewing area 188 is L2.

When the embroidery frame 5 is the embroidery frame 284 (the −45 degree frame), a sewing area 288 is set inside the inner frame 81, as shown in FIG. 5. The angle C3 formed between the long side direction of the rectangular sewing area 288 and the extension direction of the frame support portion 58 is −45 degrees. The central position of the sewing area 288 is (X1, Y1), and the origin P of the embroidery coordinate system is set to this position. The length of the short sides of the sewing area 288 is L1 and the length of the long sides of the sewing area 288 is L2.

The CPU 61 arranges the embroidery pattern identified at step S2, corresponding to the sewing area 87 set at step S11 (step S12). Specifically, the CPU 61 sets the central position of the embroidery pattern to the center point of the sewing area 87. Further, the CPU 61 sets the angle of the embroidery pattern to match the long side direction of the rectangular sewing area 87. The CPU 61 sets the angle of the sewing area 87 as the angle of the embroidery pattern. When the embroidery frame 5 is the embroidery frame 84 (the 0 degree frame), the embroidery pattern is arranged at an initial angle that is defined by the embroidery data. When the embroidery frame 5 is the embroidery frame 184 (the 45 degree frame), the embroidery pattern is arranged at an angle that is rotated clockwise by 45 degrees from the initial angle defined by the embroidery data. When the embroidery frame 5 is the embroidery frame 284 (the −45 degree frame), the embroidery pattern is arranged at an angle that is rotated counterclockwise by 45 degrees from the initial angle defined by the embroidery data.

Next, the CPU 61 controls the drive circuit 135 and displays on the LCD 7 at least one of the sewing area 87 set at step S11 and the layout of the embroidery pattern set at step S12 (step S13). In the present embodiment, the CPU 61 displays on the LCD 7 both the sewing area 87 set at step S11 and the layout of the embroidery pattern set at step S12. When the embroidery frame 84 (the 0 degree frame) is used, a screen 150 shown in FIG. 12 may be displayed on the LCD 7. A sewing area 151 and an embroidery pattern 152 are both displayed on the screen 150. The center point of the sewing area 151 matches the center point of the embroidery pattern 152. The four sides of the rectangular sewing area 151 are respectively parallel to the four sides of the rectangular screen 150.

When the embroidery frame 184 (the 45 degree frame) is used, a screen 153 shown in FIG. 13 may be displayed on the LCD 7. A sewing area 154 and an embroidery pattern 155, which are obtained by rotating the sewing area 151 and the embroidery pattern 152 shown in FIG. 12 clockwise by 45 degrees (shown by the angle C2) around the center point, are both displayed on the screen 153. When the embroidery frame 284 (the −45 degree frame) is used, a screen 156 shown in FIG. 14 may be displayed on the LCD 7. A sewing area 157 and an embroidery pattern 158, which are obtained by rotating the sewing area 151 and the embroidery pattern 152 shown in FIG. 12 counterclockwise by 45 degrees (shown by the angle C3) around the center point, are both displayed on the screen 156.

The CPU 61 waits until the CPU 61 detects the command to start sewing (no at step S14). In the present embodiment, when the start/stop switch 41 is depressed, the command to start sewing is input. When the CPU 61 detects the command to start sewing (yes at step S14), stitches that represent the embroidery pattern are formed corresponding to the layout in accordance with the embroidery data (step S15). Specifically, the CPU 61 controls the drive circuit 123 and causes the needle bar case 21 to move in the left-right direction. As a result, one of the ten needle bars 31 is moved to the sewing position. The CPU 61 drives the embroidery frame movement mechanism 11 by controlling the drive circuits 131 and 133, and moves the embroidery frame 5 to the position indicated by the embroidery data. The CPU 61 controls the drive circuit 121 to rotate and drive a drive shaft (not shown in the drawings) by the drive shaft motor 122. As a result, the needle bar drive mechanism 32 and the thread take-up lever drive mechanism are driven, and the needle bar 31 located in the sewing position and the thread take-up lever 19 corresponding to the needle bar 31 located in the sewing position are driven to move in the up-down direction. The shuttle drive mechanism (not shown in the drawings) is driven by the rotation of the drive shaft motor 122, and the shuttle (not shown in the drawings) is rotated and driven. In this manner, the needle (not shown in the drawings), the thread take-up lever 19 and the shuttle are synchronized and driven, and the stitches are formed on the sewing workpiece. When the sewing is complete, the CPU 61 ends the main processing.

The sewing machine 1 is configured to be mounted with one of a plurality of types of the embroidery frames 5 in which combinations of the sizes of the sewing area 87 and the position and the angle of the holding portion 83 with respect to the frame support portion 58 of the embroidery frame 5 are different from each other. Based on the detection result of the detector 47, the sewing machine 1 sets the size of the sewing area 87 and the position and the angle of the holding portion 83 with respect to the frame support portion 58. Therefore, when a selected one of the plurality of types of the embroidery frames 5 is mounted on the frame support portion 58, the sewing machine 1 can automatically set the sewing area 87 corresponding to the type of the embroidery frame 5. With the sewing machine 1, depending on the sewing workpiece, the user can select and use any one of the plurality of types of the embroidery frames 5, such as one of the embroidery frames 84, 184 and 284, which have the same size and in which the angles of the embroidery frame 5 with respect to the frame support portion 58 are different from each other. The sewing machine 1 can set the sewing area 87 corresponding to a variety of types of the embroidery frames 5 in comparison to the related art. It is therefore possible to perform embroidery sewing on a variety of sewing workpieces in comparison to the related art.

The sewing machine 1 can set, corresponding to the type of the embroidery frame 5, the size of the sewing area 87, as well as the angle of the sewing area 87 with respect to the frame support portion 58, by referring to the frame table 68 of the flash ROM 64. The sewing machine 1 can automatically set the layout of the embroidery pattern in accordance with the settings of the sewing area 87. Therefore, the sewing machine 1 can eliminate the user's troublesome operations, such as inputting the information to identify the type of the embroidery frame 5 into the sewing machine 1, or inputting the command to change the layout of the embroidery pattern in accordance with the settings of the sewing area 87.

The shoe S of the above-described embodiment interferes with the pair of left and right support portions 2 of the sewing machine 1 when the shoe S is held by the embroidery frame 84. Therefore, the sewing machine 1 cannot perform embroidery sewing on the shoe S held by the embroidery frame 84. In this manner, depending on the size and the shape of the sewing workpiece, there are cases in which a member (for example, the support portions 2) provided in the sewing machine 1 interferes with the sewing workpiece and the sewing machine 1 cannot sew the sewing workpiece. With a known sewing machine, a user can mount a selected one of the plurality of types of embroidery frames having different sizes on the sewing machine However, the known embroidery frames may not be suitable for sewing the shoe S. In contrast to those, the embroidery frames 184 and 284 are configured such that the holding portion 83 holds the sewing workpiece in a position in which the long side direction of the sewing workpiece is inclined at the predetermined angle with respect to the extension direction of the frame support portion 58 (the long side direction of the mounting portion 190 and 290). Thus, as shown in FIG. 9, the embroidery frames 184 and 284 can hold the shoe S, which may not be held by the known embroidery frames, between the pair of left and right support portions 2 such that the shoe S can be sewn. In other words, the sewing machine 1 can sew the embroidery pattern on a side surface of the shoe S without increasing the size of the sewing machine 1.

Figure 14:
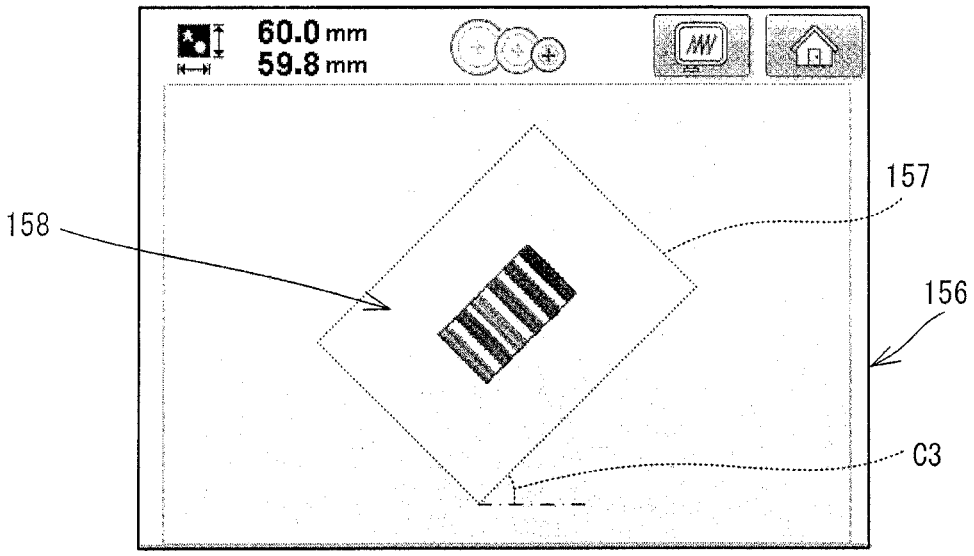
FIG. 14 is an explanatory diagram of a screen 156 that is displayed on the LCD 7.

In the related art, there are no embroidery frames 5, such as the embroidery frames 184 and 284 exemplified in the present embodiment, in which each of the long side direction and short side direction of the rectangular holding portion 83 is inclined with respect to the extension direction of the frame support portion 58 (the long side direction of the mounting portion of the embroidery frame). For that reason, the known sewing machine need not set the angle of the embroidery pattern corresponding to the type of the embroidery frame 5. In contrast to this, the sewing machine 1 matches the angle of the holding portion 83 with the angle of the sewing area 87 and with the angle of the embroidery pattern. The sewing machine 1 can automatically arrange the embroidery pattern by aligning the embroidery pattern in the long side direction of the holding portion 83 (the sewing area 87) with respect to the frame support portion 58. Therefore, the user can adjust the holding position by the holding portion 83 by using the long side of the rectangular holding portion 83 as a reference. Therefore, the user can adjust the holding position while predicting the finish of the embroidery. For example, when the embroidery pattern 158 shown in FIG. 14 is arranged for the shoe S shown in FIG. 9, the sewing machine 1 can form six linear patterns included in the embroidery pattern 158 in a direction substantially orthogonal to the shoe bottom of the shoe S.

Through the processing at step S13, the settings of the sewing area 87 and the layout of the embroidery pattern are displayed on the LCD 7. Therefore, the user can easily confirm the layout of the sewing area 87 and the embroidery pattern. The sewing machine 1 can reduce the possibility that the finish of the embroidery is different from the screen displayed on the LCD 7.

In the present embodiment, the X-axis motor 132 and the Y-axis motor 134 are stepping motors. The stepping motor rotates in a step unit that is defined by the product of the step angle and the number of pulse signals. Therefore, when the embroidery frame movement mechanism 11 moves the embroidery frame 184 in the direction of 45 degrees or the embroidery frame 284 in the direction of −45 degrees, it is sufficient that the X-axis motor 132 and the Y-axis motor 134 rotate simultaneously at the same angle, and efficiency is therefore good. That is, when the embroidery pattern is rotated in accordance with the angle of the sewing area 87 and is sewn, it is possible to perform sewing more efficiently using one of the embroidery frames 184 and 284, in comparison to a case in which the angle of the long sides of the holding portion 83 with respect to the extension direction of the frame support portion 58 is an angle that is neither 45 degrees nor −45 degrees.

The sewing machine according to the present disclosure is not limited to the embodiments described above, and various types of modifications may be made insofar as they are within the scope of the present disclosure. For example, the modifications (A) to (D) described below may be made as desired.

(A) The configuration of the sewing machine 1 may be modified as desired. The sewing machine may also be another type of sewing machine, such as an industrial sewing machine, a home-use sewing machine, or the like, for example. As long as the detector 47 can detect the type of the embroidery frame 5, the detector 47 may be another sensor, such as a position sensor, instead of the rotary potentiometer.

(B) For example, the holding portion of the embroidery frame 5 may include an upper frame and a lower frame, and may hold the sewing workpiece by clamping the sewing workpiece in the up-down direction. The pressing portion 393 of the embroidery frame 5 may have a shape other than a pin shape. The types and the number of types of the embroidery frames that can be mounted on the sewing machine 1 may be changed as necessary. The type of the embroidery frame may be shown, for example, by the shape and the size of the holding portion and a combination of the position and the angle of the holding portion with respect to the frame support portion. The angle of the holding portion in the long side direction with respect to the extension direction of the frame support portion (the long side direction of the mounting portion of the embroidery frame) may be changed as necessary.

(C) The programs that contain the instructions for performing the main processing in FIG. 11 and the data may be stored in a storage device of the sewing machine 1 before the sewing machine 1 (the device that creates the embroidery data) executes the programs. Therefore, the methods by which the programs and the data are acquired, the routes by which they are acquired, and the device in which the programs are stored may each be modified as desired. The data and the programs, which are executed by the processor of the sewing machine 1, may be received from another device through one of a cable and wireless communications, and they may be stored in a storage device such as a flash memory or the like. The other device may be, for example, a personal computer or a server that is connected through a network.

(D) The individual steps in the main processing in FIG. 11 may not necessarily be performed by the CPU 61, and some or all of the steps may also be performed by another electronic device (for example, an ASIC). The individual steps of the main processing may also be performed by distributed processing among a plurality of electronic devices (for example, a plurality of CPUs). The order of the individual steps in the main processing and the sewing processing can be modified as necessary, and steps can be omitted and added. Furthermore, a case in which an operating system (OS) or the like that is operating in the sewing machine 1 performs some or all of the actual processing, based on commands from the CPU 61 of the sewing machine 1, and the functions of the embodiment that is described above are implemented by that processing, falls within the scope of the present invention. The modifications hereinafter described in paragraphs (D-1) to (D-4) may also be applied to the main processing in FIG. 11 as desired.

(D-1) The method for identifying the embroidery pattern may be changed as necessary. For example, the embroidery pattern may be automatically set in accordance with conditions, such as the size of the sewing area and a color of the thread supplied to the needle.

(D-2) The processing that sets the sewing area may be changed corresponding to the type of the embroidery frame 5 that can be mounted on the sewing machine 1. For example, when the size of the sewing area is the same between each of the plurality of types of the embroidery frames 5, the sewing machine 1 may uniformly set the same size without depending on the type of the embroidery frame 5.

(D-3) It is sufficient that the layout of the embroidery pattern is set in accordance with the settings of the sewing area. For example, when the sewing area has an oval shape, the angle of the sewing area in the long side direction with respect to the extension direction of the frame support portion 58 may be the same as the angle of the embroidery pattern. The sewing machine 1 may arrange the embroidery pattern such that a representative point of the sewing area matches a representative point of the embroidery pattern. The representative point of the sewing area may be set, as appropriate, corresponding to the shape of the sewing area. When the sewing area is rectangular, the representative point may be, for example, one of the four vertices of the rectangular sewing area. The representative point of the embroidery pattern may be, for example, one of the four vertices of the smallest rectangle that contains the embroidery pattern.

(D-4) In the processing at step S13, the CPU 61 may display an image that shows one of the sewing area 87 and the layout of the embroidery pattern. The processing at step S13 may be omitted if necessary.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a frame support portion configured to be detachably mounted with a selected one of a plurality of embroidery frames whose types are different from each other, each of the embroidery frames having a holding portion that is configured to hold a sewing workpiece at an angle;

a detecting device configured to detect a type of the embroidery frame mounted on the frame support portion;

a storage device configured to store pieces of information about types of the plurality of embroidery frames, each of the pieces of information indicating a size, a position and an angle of a sewing area for each of the types of the plurality of embroidery frames;

a processor; and a memory configured to store computer-readable instructions that, when executed by the processor, instruct the processor to perform processes comprising:

setting a sewing area inside the holding portion, based on information corresponding to the type of the embroidery frame detected by the detecting device, among the pieces of information about the types of the plurality of embroidery frames that are stored in the storage device, the sewing area being an area in which stitches can be formed, the setting the sewing area including setting a size, a position and an angle of the sewing area, the position and the angle of the sewing area being respectively a position and an angle of the sewing area with respect to the frame support portion;

identifying an embroidery pattern to be sewn on the sewing workpiece; and setting a layout of the identified embroidery pattern, corresponding to the sewing area.

2. The sewing machine according to claim 1, wherein the setting of the layout of the identified embroidery pattern includes setting a position and an angle of the embroidery pattern with respect to the frame support portion, based on the set sewing area.

3. The sewing machine according to claim 1, wherein the sewing area that corresponds at least one of the plurality of embroidery frames is a rectangular area, each of a long side direction and a short side direction of the rectangular area being inclined with respect to an extension direction of the frame support portion, and the setting of the layout of the identified embroidery pattern includes setting an angle of the embroidery pattern to an angle that matches a long side direction of the set sewing area when the type of the embroidery frames is detected by the detecting device.

4. The sewing machine according to claim 1, further comprising:

a display device; and wherein the computer-readable instructions further instruct the processor to perform process comprising: causing the display device to display at least one of the sewing area and the layout of the set embroidery pattern.

5. The sewing machine according to claim 3, further comprising:

a pair of leg portions that form a base portion of the sewing machine, and an embroidery frame that is configured to be detachably mounted on the frame support portion, the embroidery frame including a holding portion configured to hold a side surface of a shoe, which is the sewing workpiece, a long side direction of the holding portion of the embroidery frame mounted on the frame support portion being inclined with respect to the extension direction of the frame support portion, the embroidery frame mounted on the frame support portion being arranged between the pair of leg portions.

6. An embroidery frame comprising:

a mounting portion configured to be detachably mounted on a sewing machine, the mounting portion including a plate member; and a holding portion configured to hold a sewing workpiece, wherein the holding portion includes a rectangular frame, an inside area of the rectangular frame is a sewing area, the sewing area is a rectangular area, each of a long side direction and a short side direction of the holding portion: (i) is angled with respect to an extension direction of a longest side of the mounting portion, and (ii) extends substantially in parallel with an extension direction of the plate member, and the sewing area is an area in which stitches can be formed.

7. The embroidery frame according to claim 6, wherein the holding portion is configured to hold a side surface of a shoe, which is the sewing workpiece, in a parallel posture, the parallel posture being a posture in which one of a shoe bottom and a shoe opening of the shoe is substantially parallel to a long side direction of one of the rectangular frame and the sewing area.

* * * * *